United States Patent [19]

Forbus, Jr.

[11] Patent Number: 4,569,774

[45] Date of Patent: Feb. 11, 1986

[54] POLYGLYCOL LUBRICANTS COMPRISING TRIFLUOROMETHANE SULFONATE

[75] Inventor: Thomas R. Forbus, Jr., Newtown, Pa.

[73] Assignee: Mobil Oil Corporation, New York, N.Y.

[21] Appl. No.: 670,444

[22] Filed: Nov. 13, 1984

[51] Int. Cl.[4] ..... C10M 131/10

[52] U.S. Cl. ..... 252/33; 252/42; 252/58

[58] Field of Search ..... 252/33, 42, 58

[56] References Cited

U.S. PATENT DOCUMENTS 4,012,330 3/1977 Brewster ..... 252/33.6

4,376,060 3/1983 Stadler ..... 252/25

OTHER PUBLICATIONS

Synthetic Lubricants, Gunderson, R. C. et al., Reinhold, N.Y. 1962, pp. 61–64.

Manufacture and Application of Lubricating Greases, Borer, C. J., Robt. E. Krieger, Huntingdon, N.Y. 1971, pp. 425–426.

*Primary Examiner*—Jacqueline V. Howard

*Attorney, Agent, or Firm*—Alexander J. McKillop; Michael G. Gilman; Malcolm D. Keen

[57] ABSTRACT

Polyglycol lubricants of improved rheological characteristics are produced by adding a lithium salt to a polyglycol liquid lubricant. Preferred lithium salt are nonnucleophilic salts such as lithium trifluoromethanesulfonate. These salts improve the pressure-viscosity characteristics of the lubricant without significantly affecting the temperature-viscosity characteristics so that thicker lubricant films are produced in elastohydrodynamic film contact.

3 Claims, No Drawings

POLYGLYCOL LUBRICANTS COMPRISING TRIFLUOROMETHANE SULFONATE

FIELD OF THE INVENTION

This invention relates to polyglycol lubricants and more particularly, to polyglycol lubricant compositions which contain additives to improve the rheological characteristics of the lubricant.

BACKGROUND OF THE INVENTION

Polyglycol lubricants have been widely and successfully used in a number of different applications for a number of years. They have been used, for example, as special purpose lubricants, hydraulic fluids, brake fluids, metal forming lubricants, automotive engine lubricants and in other applications they are notable for the wide viscosity range in which they are available and for their generally superior viscosity indices; they have also demonstrated particular utility in high temperature applications because of their outstanding response to anti-oxidant additives. When properly inhibited, polyglycol lubricants are relatively stable toward oxidation and pyrolysis at temperatures as high as 200° C. or even higher. Furthermore, the products of oxidative and thermal degradation are either volatile or soluble in the residual lubricant so that problems of sludge deposition are minimized. In addition, the polyglycols show a minimal tendency to the formation of varnish and other highly carbonaceous deposits even when exposed to decomposition temperatures for prolonged periods of time.

Polyglycol derivatives that have been widely used as lubricants are described, for example, in U.S. Pat. Nos. 2,425,755; 2,448,664; 2,520,611 and 2,520612.

However, there is a continuing need to improve the properties of these materials even further so that their potential utility may be further enlarged and their desirable properties exploited to the full. One area where improvements are desirable is in the contribution of the fluid to the formation of an elastohydrodynamic (EHD) film under pressure. This contribution, which is a function of the viscosity and the pressure-viscosity properties of a lubricant, is a measure of how well the lubricant will perform under conditions of extreme pressure. Improvements in this property are therefore desirable in order to improve the high pressure lubricating characteristics of the lubricant.

SUMMARY OF THE INVENTION

I have now found that significant improvements in the elastohydrodynamic film formation properties of polyglycols without significant modification of their temperature-viscosity properties can be obtained by the addition of certain electrolytes to the polyglycol base fluids. As a result of this, thicker lubricant films can be formed by these modified fluids at a given fluid viscosity. Thus, the potential exists for formulating polyglycol lubricants which, at a given viscosity, have improved pressure-viscosity characteristics, indicating that they will provide thicker lubricant films under conditions of high pressure in an elastohydrodynamic contact than the unmodified base fluid.

According to the present invention, the electrolytes which may be added to the polyglycols are lithium salts and the lubricant compositions according to the invention therefore comprise a polyglycol liquid lubricant containing a minor amount, sufficient to improve the pressure-viscosity properties of the lubricant, of a lithium salt. Preferred lithium salts are non-nucleophilic salts of which lithium trifluoromethanesulphonate is preferred.

DETAILED DESCRIPTION

The lubricant base fluid comprises a polyglycol liquid lubricant. Polyglycol lubricants are well known materials and are commerically available from a number of different suppliers, for example, the "Ucon" (trademark) fluids of Union Carbide. Polyglycol lubricants are generally prepared by the addition of an alkylene oxide to a hydroxyl group-containing compound such as an alcohol or a polyol such as glycerol. Depending upon the amount of alkylene oxide relative to the hydroxal group containing compound, the number of oxyalkylene units in the resulting polyglycol will vary, thereby producing products of different molecular weight and characteristics. The hydroxyl groups on the reaction product may be capped by using capping agents such as alkyl halides and sulfates, fatty acids, acyl chlorides and acids anhydrides. The alkylene oxides used in the initial preparative step are usually ethylene oxide, propylene oxide or mixtures of these two oxides.

An extensive description of synthetic polyglycol lubricants is given in Synthetic Lubricants, Ed. Gundersen and Hart, Reinhold Publishing Corporation, New York 1962 (Chapter 3) to which reference is made for a description of these lubricant fluids.

When lubricants form an elastohydrodynamic (EHD) film separating two relatively moving solid surfaces, the thickness of the film formed by the lubricant is a function of the viscosity of the lubricant and its pressure-viscosity properties. Viscosity, in turn, is a function of temperature and generally decreases with increasing temperature. The thickness of the film is therefore determined not only by the temperature of the film but also by the manner in which the viscosity of the film varies with pressure. Under increasing pressure, the viscosity of the film increases and as the viscosity increases, so does the thickness of the film. Because it is desirable to have a relatively thick film, the pressure-viscosity characteristics of the lubricant should be such that the rate of increase of viscosity with increasing pressure should be as great as possible. If this can be secured without increasing the viscosity of the lubricant under ambient conditions, a superior lubricant will be obtained because it will possess a viscosity under ambient conditions which permits it to flow readily while, at the same time, possessing a viscosity under conditions of EHD contact which produces a thick EHD film, giving good separation of the lubricated surfaces.

The pressure-viscosity characteristics of polyglycol lubricants are improved by the addition of lithium salts to the polyglycols. The salts which are used are preferably non-nucleophilic salts such as lithium trifluoromethanesulfonate, although other lithium salts such as lithium chloride and lithium sulfate may also be used, although to less advantage. The salt should, however, be selected so that it will not react deleteriously with the base fluid under conditions of use and for this reason nucleophilic salts such as lithium perchlorate and other strongly oxidizing salts are preferably avoided in order to avoid the hazards of uncontrolled oxidation at high temperatures. It is believed that the presence of heteroatoms (ether oxygens) in the molecular structure of the polyglycols may be responsible for an interaction with the added electrolytes, possibly by the formation of lithium complexes with the oxygens in the polyglycol structures. Whatever the mechanism, however, the use of lithium electrolytes produces improvements in the pressure-viscosity characteristics without significant alteration in the temperature-viscosity characteristics, thereby providing a lubricant of improved properties.

The lithium salts are used in minor amounts, sufficient to confer the desired improvement in the pressure-viscosity characteristics but excessive amounts which might result in precipitation of the salt should be avoided because the presence of solid particles in the lubricant will lead to abrasion of the lubricated surfaces, clogging of filters and other operational problems. Generally, the amount of the elctrolyte will be from 0.1 to 10 percent by weight, based on the weight of the entire composition, preferably from 0.5 to 5 percent by weight and in most cases from 0.5 to 3 percent by weight will be sufficient in order to obtain the desired improvement in lubricant properties.

EXAMPLE 1

Anhydrous lithium salts ($LiCF_3SO_3$, $LiNO_3$ and LiCl) were dissolved in a polyglycol base stock derived from dipropylene glycol. Kinematic viscosities at 38° C. (100° F.) and 99° C. (210° F.) were measured and monitored with time. It was found that the lithium trifluoromethanesulfonate ($LiCF_3SO_3$) formed a stable solution (2 percent $LiCF_3SO_3$) in the base fluid with no evidence of decomposition after 7 days at 99° C. Lithium chloride precipitated at 99° C. when present at the 2 percent by weight concentration but was stable to precipitation at a concentration level of 0.9 percent. However, discoloration of the polyglycol occurred at 99° C. indicating some apparent decomposition. Lithium nitrate (0.9 percent solution) also caused apparent decomposition (discoloration) of the polyglycol at 99° C.

EXAMPLES 2 AND 3

The film thicknesses generated in an EHD contact using a polyglycol lubricant were measured by optical interferometry at various temperatures. Determinations were made using a 2 percent lithium trifluoromethane solution and a 0.9 percent solution of lithium chloride. The polyglycol in both cases was the same as that used in Example 1. The results are shown in Table 1 below which reports the viscosity of the lubricant at various temperatures together with the relative film thickness, in arbitrary units.

TABLE 1

| | Polyglycol Lubricant Properties | | | | | |
|---|---|---|---|---|---|---|
| | | | Ex. 2 Base Fluid + 0.9 Percent LiCl | | Ex. 3 Base Fluid + 2.0 Percent $LiCF_3SO_3$ | |
| | Base Fluid | | | | | |
| Temp. °C. | Visc., (cP) | Film | Visc., (cP) | Film | Visc., (cP) | Film |
| 20 | 198.0 | 85.2 | 267.7 | 128.7 | 203.5 | 113.9 |
| 40 | 74.3 | 35.8 | 95.4 | 50.1 | 79.8 | 46.3 |
| 60 | 34.3 | 18.5 | 42.3 | 24.7 | 37.9 | 22.7 |
| 80 | 18.4 | 10.7 | 22.0 | 13.1 | 20.7 | 12.7 |
| 100 | 11.0 | 6.8 | 12.8 | 8.0 | 12.6 | 7.9 |
| VI | 147 | | 140 | | 155 | |

The results show that at equivalent viscosities, thicker films occurred with the electrolyte solutions that with the unmodified polyglycol over the temperature range started.

The determinations also showed that at a viscosity of 100 cP the film thickness in the EHD contact was 12 percent greater for the electrolyte solution of Example 2 (base fluid + LiCl) and 24 percent greater for the electrolyte solution of Example 3 (base fluid + $LiCF_3SO_3$) than for the unmodified base fluid.

Based upon linear correlations of the EHD film thickness, $h_o$, and the absolute viscosity, $\eta$, it may be shown for the base fluid that $$h_o=0.847(\eta)^{0.870}$$

for the base fluid with 0.9 percent LiCl $$h_o=0.778(\eta)^{0.914}$$

and for the base fluid with 2.0 percent $CF_3SO_3Li$ that $$h_o=0.695(\eta)^{0.959}$$

indicating that the EHD film thickness is improved by the use of the lithium salt electrolytes.

The improvements in the pressure-viscosity characteristics are brought about, moreover, without significantly altering the temperature viscosity characteristics. Also, at the concentrations stated, the addition of the electrolytes did not significantly change the viscosity of the polyglycol. This means that the film thickness is considerably increased at equivalent absolute viscosities relative to the unmodified glycol. Further, the improvement in pressure-viscosity coefficient without an accompanying increase in viscosity-temperature coefficient implies that thicker lubricant films are produced with the electrolyte solutions relative to the unmodified glycol at equivalent temperatures.

I claim:

1. A lubricant which comprises a liquid polyglycol lubricant and a minor amount, sufficient to improve the pressure-viscosity characteristics of the lubricant, of lithium trifluoromethane sulfonate.

2. A lubricant according to claim 1 in which the lithium salt is present in an amount from 0.1 to 10 percent by weight of the entire lubricant.

3. A lubricant according to claim 2 in which the lithium salt is present in an amount from 0.5 to 5 percent by weight of the entire lubricant.

* * * * *